US005185891A

United States Patent [19]

Rise

[11] Patent Number: 5,185,891

[45] Date of Patent: Feb. 16, 1993

[54] WATER CONSERVING TOILET FLAPPER VALVE CONTROL

[76] Inventor: Leif Rise, 7748 Westlawn Ave., Los Angeles, Calif. 90045

[21] Appl. No.: 699,333

[22] Filed: May 13, 1991

Related U.S. Application Data

[63] Continuation-in-part of Ser. No. 493,620, Mar. 15, 1990, Pat. No. 5,031,254.

[51] Int. Cl.[5] ..... E03D 1/14

[52] U.S. Cl. ..... 4/324; 4/314; 4/415; 33/531; 33/567

[58] Field of Search ..... 4/324, 325, 401, 415, 4/314; 33/501.45, 531, 567, 532, 534, 562, 662

[56] References Cited

U.S. PATENT DOCUMENTS

| | | | |
|---|---|---|---|
| 2,134,062 | 10/1938 | Trbojevich | 33/567 |
| 2,815,679 | 8/1950 | Graham | 4/401 |
| 4,114,204 | 9/1978 | Blach | 4/324 |

*Primary Examiner*—Charles E. Phillips
*Attorney, Agent, or Firm*—William H. Maxwell

[57] ABSTRACT

A manual flush control for toilets having a normally closed flapper type float valve held shut by the head of water pressure in the flush tank, and characterized by a height limiting means for said valve to cause servo closing and preempting automatic operation.

12 Claims, 1 Drawing Sheet

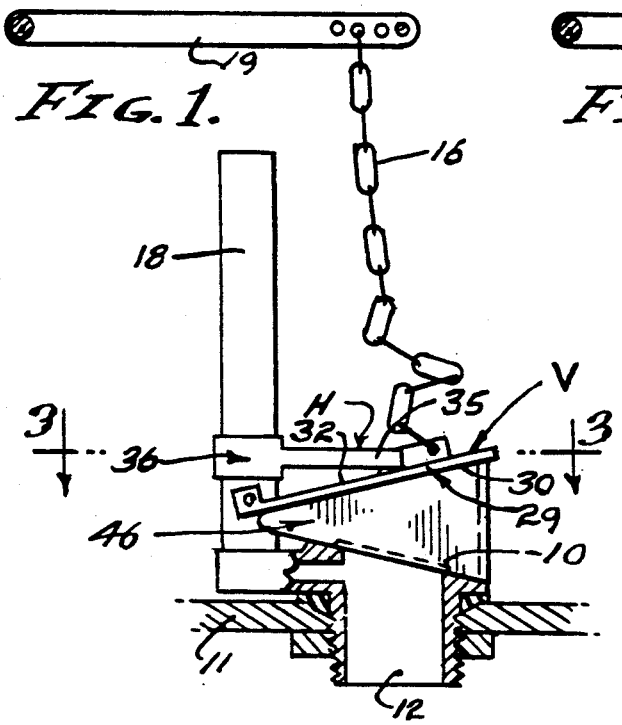
FIG. 1.
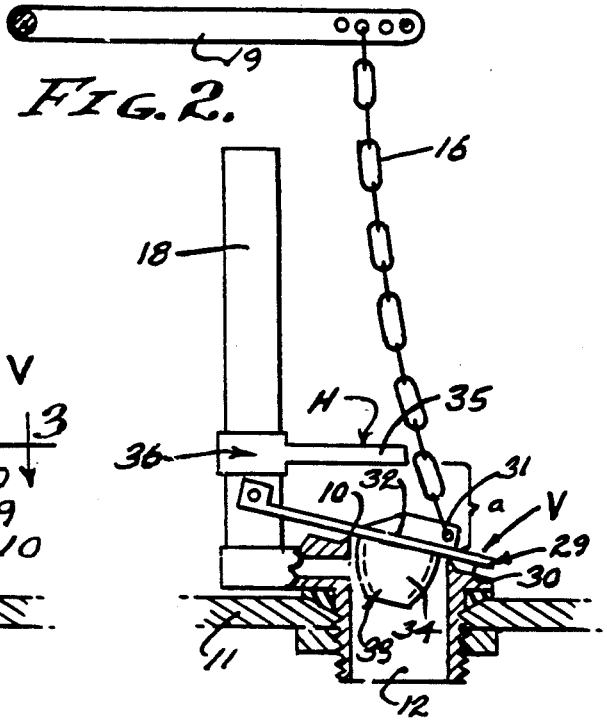
FIG. 2.
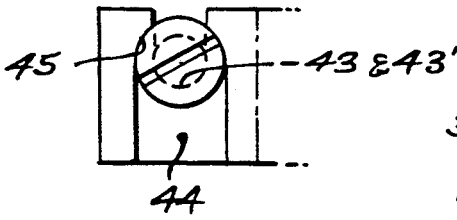
FIG. 6.
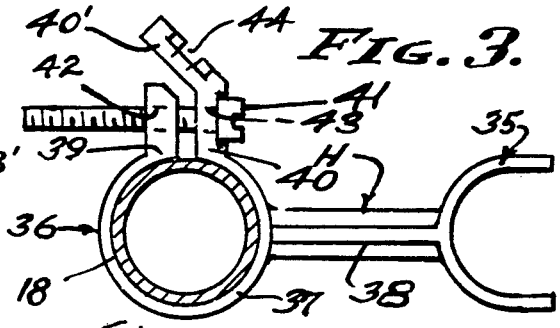
FIG. 3.
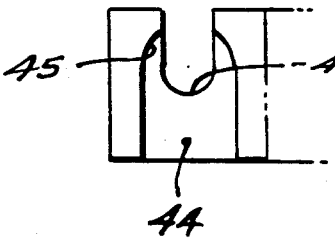
FIG. 7.
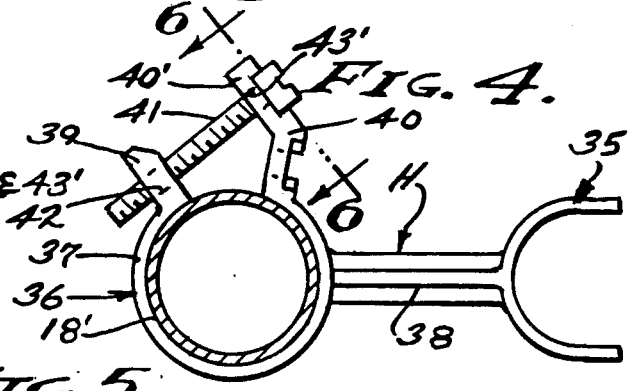
FIG. 4.
FIG. 5.
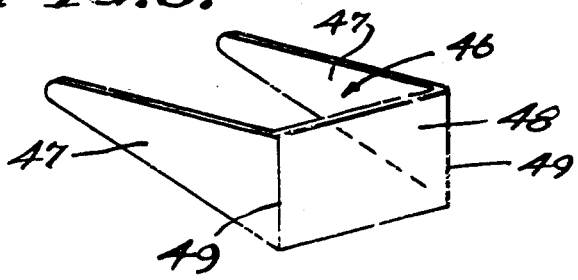

WATER CONSERVING TOILET FLAPPER VALVE CONTROL

This is a continuation in part of application Ser. No. 07/493,620 filed Mar. 15, 1990 and issued Jul. 16, 1991 as U.S. Pat. No. 5,031,254.

BACKGROUND OF THE INVENTION

This invention relates to toilet flush systems that are in wide use and characterized by a floating flapper valve. This is the flush valve that holds a substantial volume of water in the flush tank, for sudden release to cause flushing of the toilet bowl, followed by refilling responsive to a float controlled filling means. This flush valve is essentially a releasable check valve held shut by the head of water pressure as the flush tank is filled, a feature of this valve being the entrapment of air within a downwardly open chamber, so that it will float upward when lifted from the valve seat, and so that it will float downward to re-seat when the water level drops to seat level. There is presently no control over these flush valves when they have been released by initial lifted from the valve seats, so that each operation of the usual flush system consumes an entire flush tank of water. Consequently, toilets of this type are designed to minimize water volume requirements, either by reducing the flush tank volume or by reducing the flush water velocity. And, as a result the flushing performance is often inadequate, so that a second flushing is often required; with the obvious over use of water. However, in the event of an insufficient flushing, a small additional surge of water will complete the operation; but this is not possible with the state of the art flush systems of the type under consideration. Therefore, it is an object of this invention to provide a control by which the discharge of flush water is manually controlled as circumstances require, whereby the flush valve can be shut the moment sufficient flushing has been attained.

It is an object to retrofit toilet flush flapper valves with a height limiting means, all without change thereto, whereby the toilet flush system is converted to manual control. The prior art principle of operation requires lifting the valve from the seat to a level where flotation overcomes the downward pull of the released flushing water, it being an object of this invention to provide limiting means that precludes reaching this flotation level by holding a restricted position below it. Consequently, the downward pull of released flushing water inherently drags the valve onto the seat to shut off flushing water flow as may be required. Therefore, only enough water need be used through observation by the user when flushing the toilet. For example, a small deposite of urine or fecal matter will require but a short burst of flushing water, and likewise an insufficient previous flushing will be completed with a short burst.

Flapper type flush valves are comprised of a large diameter body establishing a float chamber, downwardly open, positioned by a lever swinging from pivots supported by an overflow tube that opens from the top of the flush tank and into the flush passage beneath the flush valve seat. The limiting means is provided herein to restrict lifting of the flapper valve by a lanyard or chain, and is in the form of a bracket and gage assembly positioned at a predetermined height on the overflow tube by a clamp means, as determined by said gage.

The overflow tube to which the height controlling bracket of the present invention is mounted, varies in outside diameter, for example from one inch to one and one quarter inch. Therefore, an object of this invention is the universal adaptation to this variation in tube size, in the clamp means that attaches to said various tubes. To this end, the bracket and clamp means is made of a flexible material and characterized by a split collar that opens to accomodate the variations in the overflow tube diameters. Accordingly, the split collar embraces less than 360° as it surrounds the overflow tube, in order to be drawn tightly onto the tube by a constricting clamp means, preferably a screw means engaged between lugs at opposed ends of the split collar.

The aforesaid variations in overflow tube diameter requires a substantial separation of the collar ends, when adapting to the larger diameter overflow tubes, and this misalignes the clamp screw axes through lugs at the opposed ends of the split collar. Therefore, it is another object of this invenion to provide alignment means in at least one lug configuration, whereby a clamp screw axis is aligned with two lugs. In practice, one of said lugs has inner and outer sections, one section to establish alignment when adapting to a small diameter overflow tube, and the other to establish alignment when adapting to a large diameter overflow tube. The material of the clamp collar is flexible so that alignment is substantially accurate and such as to flexibly adjust to slight misalignments and intermediate alignments as well.

It is still another object of this invention to provide an inexpensive product, and to this end the bracket and clamp member is a pressure molded plastic part, produced from a simple male and female mold without core slides. Also, the material used is necessarily flexible, for those reasons above stated, in which case the screw alignment must be secured. Accordingly, the screw head is captured by means of a shouldered recess that is opposed to a saddle that supports the body or shank of the screw. This feature is accomplished in the mold configuration that involves "shut-offs" in the mold (see FIGS. 3, 6 and 7), rather than "core slides".

SUMMARY OF THE INVENTION

This invention is characterized by height limiting means that restricts lifting of a flush valve from a flush valve seat in a toilet having a flush tank that is automatically filled with water to a controlled level. It is a flush valve having a float chamber with which this invention is concerned, it being a general object to prevent automatic full flushing each and every time the toilet is flushed. On the contrary, it is the purpose of this invention to enable discrete manipulation of a completely controlled flushing system whereby adequate flushing is attainable on every occasion, with the use of only that amount of water which is necessary for adequate flushing. As will be described, the limiting means herein disclosed is applicable to retrofit existing toilets without any alterations, simply by affixing a height limiting means to the overflow tube or like part of the toilet. Extreme simplicity and practicality is the essence of this invention.

The foregoing and various other objects and features of this invention will be apparent and fully understood from the following detailed description of the typical preferred forms and applications thereof, throughout which description reference is made to the accompanying drawings.

THE DRAWINGS

FIG. 1 is a sectional view of a flapper type float valve mechanism, with the limiting means and gage assembly of the present invention adapted thereto.

FIG. 2 is a view similar to FIG. 1 showing the valve mechanism with the gage of the assembly removed and with the limiting means of the invention in its passive ready condition.

FIG. 3 is an enlarged view of the limiting means mounted to a small diameter overflow tube taken as indicated by line 3—3 on FIG. 1.

FIG. 4 is a view similar to FIG. 3 and shows the same limiting means mounted to a large diameter overflow tube.

FIG. 5 is a perspective view showing the gage which is part of the assembly in FIG. 1.

And FIGS. 6 and 7 are enlarged fragmentary views, FIG. 6 being taken as indicated by line 6—6 on FIG. 4 and rotated so as to appear erect, and FIG. 7 being a view similar to FIG. 6 with the clamp screw removed.

PREFERRED EMBODIMENT

Referring to the drawings, there are a number of widely used flush valves for toilets, and among which there is the tilt flapper type float valve V as shown. These are check valves that close a large diameter valve seat 10 opening from a flush tank 11 to permit the flow of flush water through a flush passage 12 when the valve is lifted. State of the art flush valves are characterized by an integral float chamber by which they are bouyant in order to remain elevated once lifted off the seat 10, until the water level subsides in the flush tank 11. This is an automatic function inherent in the operation of state of the art toilets, by means of a flexible lanyard or a loosely linked chain 16 to initially lift the flapper type float valve V. The lanyard or chain 16 requires no guide, either being lifted by a manually operated lever 19. The toilet mechanism thus far described is standard.

The flapper type float valve V is shown in FIGS. 1 and 2, comprised of a large diameter body 29 or rubber or the like having a downwardly faced planar sealing face 30 to engage on the upwardly faced valve seat 10. The lift chain 16 is coupled into the center of the valve body 29, through a loop or suitable connector 31 in a top wall 32 of the body 29, there being a depending peripheral ball 33 within the face 30 and the valve seat 10. A characteristic feature of the valve V is that it is bouyant, and to this end the body 29 is formed by the wall 32 and ball 33 to establish a float chamber 34 by which the valve body 29 will float. In practice, the chamber 34 is downwardly open so as to trap a body of air for flotation.

In accordance with this invention, the height to which the flapper type float valve V can be lifted is restricted by height limiting means H, restricting the height of said valve with respect to the seat 10 from which it is lifted to cause flushing of the toilet. The restricted height is sufficient to permit the downward rush of water into and through the flush passage 12, but insufficient for the air chamber 34 to float the valve V away from the seat 10. Simultaneously during a flushing operation, the rush of flushing water inherently drags the float valve V toward the seat 10, so that an opened position thereof must be manually held through operation of the lever 19, and so that a closed position thereof is regained by simply releasing the lever 19. It is the dynamic flow of rushing flush water that provides a servo function shutting the flapper valve V, and precludes it from remaining open.

The height limiting means H is a stop that restricts the lifting of the flapper type float valve V, and in its preferred form is a forked stop bracket 35 secured to the overflow tube 18 as by a securement or clamp means 36. As is clearly shown, the stop bracket 35 is positioned on the tube 18 to engage the planar top wall 32 of the valve V when the aforementioned height limitation is reached, whereby flotation of the float valve V is precluded while flushing occurs. A feature of this invention is the closely proximate predetermined height of the bracket.

Referring now to the securement or clamp means 36, said means is adapted to accomodate a wide range of overflow tube diameters, and is preferably a split collar and screw clamp means. As shown, there is a split collar 37 joined to the bracket 35 by a horizontal arm 38. The collar 37 embraces less than the full diameter of the smaller overflow tube 18 (see FIG. 3) and for example 355°. And, said collar 37 embraces substantially less of the diameter of the larger overflow tube 18' (see FIG. 4) and for example 310°. Accordingly, there are clamp lugs 39 and 40 at opposite ends of the split collar, divergent from the condition of FIG. 3 as they open in the condition of FIG. 4. The material of which the collar is made is flexible, so that the inside of the collar conforms to the diameter of the overflow tubes, as shown.

The clamp lugs 39 and 40 are substantially radial projections, with aligned openings to receive a clamp screw 41 by which the clamp lugs are drawn together. The opening 42 in lug 39 is drilled and tapped, as by a self tapping screw. The opening 43 in lug 40 is aligned with opening 42 in the small tube diameter condition of FIG. 3, the opening 43 being an inner opening as distinguished from an outer opening 43' for alignment with opening 42 in the large diameter condition of FIG. 4. The openings 43 and 43' are alike, a description of one sufficing for the other. Accordingly, the lug has inner and outer sections 40 and 40' in which are the openings 43 and 43' respectively. The opposing inner face of section 40 is substantially radial, whereas the opposing inner face of section 40' is turned angularly, for example at 45°, toward the opposed lug 39. Accordingly, in the large tube diameter FIG. 4 condition the opening 43' is substantially aligned with the opening 42 as shown.

In accordance with this invention, the openings 43 and 43' are produced in the form of side opening saddles (see FIG. 7), the head of the clamp screw 41 being captured in a recess 44 having a shoulder 45 diametrically opposed, relative to the screw axis, to the saddle shaped opening 43 or 43'. Therefore, when the screw body is positioned upon the saddle shaped opening 43 or 43', the screw head is held captive by the shoulder 45 of the recess that is opposed thereto (see FIGS. 6 and 7). As shown, the saddle shaped openings 43 or 43' and recesses 44 open oppositely and are offset so as to capture the screw 41.

Referring now to FIG. 5 of the drawings, there is a template or gage member 46 for assembly over the valve seat 10 and beneath the planar seal portion of the valve V, for establishing an angularly offset dimension a (see FIG. 2) as the limit of lifting motion of the chain and valve V lifted thereby. The planar top wall 32 is shown pivoted by means of a pair of integral arms (see FIG. 1) that embrace the overflow tube 18 to rotate on transversely aligned trunions carried by the tube, and into an adjusted position as determined by the gage member 46 that is assembled therewith as shown in FIG. 1. Characteristically, the valve V is molded of a soft and pliable polymer, and a variation in its mounting on the overflow tube is the use of a flap-like arm integral therewith and having an opening stretched over said tube. Flexibility of the pliant arm permits lifting movement of the valve. The gage 46 is an expendable member comprised of spaced triangular wedges 47 having angularly divergent coplanar edges, one pair of edges to engage on or at and/or surrounding the seat 10, and the other pair of edges to engage with and locate the wall 32.

The gage member 46 is formed of sheet material wherein the wedges 47 are joined by a header 48 at parallel corners 49. In carrying out this invention, the gage member 46 is assembled with the height limiting means H to position the bracket 35 as clearly shown in FIG. 1. The clamp means 36 is then tightened onto the overflow tube 18 so as to establish the height limit dimension a. Finally, the gage member 46 is removed, whereupon the toilet is fully operative with the water saving feature implemented.

Having described only the typical preferred forms and applications of my invention, I do not wish to be limited or restricted to the specific details herein set forth, but wish to reserve to myself any modifications or variations that may appear to those skilled in the art as set forth within the limits of the following claims.

I claim:

1. A toilet flush control for toilets having a flush tank with a valve seat normally closed by a bouyant flapper type float valve held shut on the seat by a head of water pressure in the flush tank, said valve having an upper surface and a lower surface having a planar sealing face surrounding a float chamber, said valve being carried by a pivot and coupled to lift means for opening thereof for pivotally bouyant separation of the sealing face from the valve seat and normal continued flushing of water through the valve seat until the flush tank is emptied, said flush control being comprised of a height limiting means having a stop for restricting pivotal separation of the float valve from the seat during normal operation of said lift means, and a removable gage insertable between said sealing face and valve seat and surrounding said float chamber such that with said valve seated on said gage said height limiting means can be moved to a position where said stop will contact said upper surface thereby establishing a restricted angular separation of the float valve with respect to the seat, which with said gage removed is insufficient for bouyant separation of the valve from the valve seat and sufficiently close to the valve seat whereby drag by means of the flushing water passing thereby will cause a servo function that closes the float valve onto the valve seat when the lift means is manually released, the height limiting means having securement means for fixing said stop at said position of contact.

2. The toilet flush control for a flapper type float valve as set forth in claim 1, wherein the stop of the height limiting means is a fork-shaped bracket engageable with a top surface of the float valve.

3. The toilet flush control for a flapper type float valve as set forth in claim 1, wherein the height limiting means is vertically adjustable on an overflow tube within the toilet flush tank.

4. The toilet flush control for a flapper type float valve as set forth in claim 1, wherein the securement means of the height limiting means is a vertically adjustable clamp means engaged on an overflow tube within the toilet flush tank.

5. The toilet flush control for a flapper type float valve as set forth in claim 1, wherein the securement means of the height limiting means is vertically adjustable on various diameter overflow tubes within the toilet flush tank by means of a flexible clamp means drawn tight thereon by screw means operable between spaced lugs at opposed ends of a split collar.

6. The toilet flush control for a flapper type float valve as set forth in claim 1, wherein the securement means of the height limiting means is vertically adjustable on various diameter overflow tubes within the toilet flush tank by mean of a flexible clamp means drawn tight thereon by screw means operable between spaced lugs at opposed ends of a split collar, one lug being threadedly engaged with said screw means, and the other lug having radially spaced side opening saddles selectively receiving a headed body end of the screw means.

7. The toilet flush control for a flapper type float valve as set forth in claim 1, wherein the securement means of the height limiting means is vertically adjustable on various diameter overflow tubes within the toilet flush tank by means of a flexible clamp means drawn tight thereon by screw means operable between spaced lugs at opposed ends of a split collar, one lug being threadedly engaged with said screw means, and the other lug having radially spaced side opening saddles and each saddle being opposed by a shoulder to selectively receive and to engage and retain a headed body end of the screw means.

8. The toilet flush control for a flapper type float valve as set forth in claim 1, wherein the securement means of the height limiting means is vertically adjustable on various diameter overflow tubes within the toilet flush tank by means of a flexible clamp means drawn tight thereon by screw means operable between spaced lugs at opposed ends of a split collar, one lug being threadedly engaged with said screw means, and the other lug having inner and outer radially spaced and angularly related side opening saddles and each saddle being opposed by a shouldered recess to selectively receive and engage and retain a headed body end of the screw means.

9. The toilet flush control for a flapper type float valve as set forth in claim 8, wherein the side opening saddles and opposed shoulders of said other lug are diametrically opposed with respect to the axis of the screw means.

10. The toilet flush control for a flapper type float valve as set forth in claim 1, wherein the removable gage means is comprised of at least one wedge with angularly divergent edges engageable one with the seat and the other with the float valve.

11. The toilet flush control for a flapper type float valve as set forth in claim 1, wherein the removable gage means is comprised of spaced wedges joined by a header and with angularly divergent coplanar edges, one pair of edges to engage at a plane of the seat and the other pair of edges to engage at a plane of the float valve and locate the angular separation of the float valve from the seat.

12. The toilet flush control for a flapper type float valve as set forth in claim 11, wherein the removable gage means is sheet material and the header thereof connecting the spaced wedges at parallel corners with the header therebetween.

* * * * *